US008506068B2

(12) United States Patent
Mimura

(10) Patent No.: US 8,506,068 B2
(45) Date of Patent: Aug. 13, 2013

(54) INKJET PRINTING METHOD AND INKJET PRINTING APPARATUS

(75) Inventor: Tomomi Mimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 12/847,597

(22) Filed: Jul. 30, 2010

(65) Prior Publication Data

US 2011/0032299 A1 Feb. 10, 2011

(30) Foreign Application Priority Data

Aug. 6, 2009 (JP) ..... 2009-183539

(51) Int. Cl.
*B41J 11/00* (2006.01)
*B41J 2/205* (2006.01)
*B41J 29/38* (2006.01)

(52) U.S. Cl.
USPC ..... 347/100; 347/15; 347/16

(58) Field of Classification Search
USPC ..... 347/100, 102, 14–16, 19
See application file for complete search history.

(56) References Cited

U.S. PATENT DOCUMENTS 6,877,850 B2 4/2005 Ishimoto et al.
2004/0032473 A1* 2/2004 Ishimoto et al. ..... 347/100
2005/0046684 A1* 3/2005 Yoneyama ..... 347/102

FOREIGN PATENT DOCUMENTS

JP 2006-272934 10/2006

* cited by examiner

*Primary Examiner* — Jason Uhlenhake
(74) *Attorney, Agent, or Firm* — Fitzpatrick, Cella, Harper & Scinto

(57) ABSTRACT

There is provided an inkjet printing method of applying plural different kinds of color ink containing pigment as a coloring agent and clear ink not containing the coloring agent on a print medium to form an image thereon. An amount of the clear ink applied in a unit area of the print medium is adjusted based upon an amount of each of the plural kinds of the color ink applied in the unit area. Since the amount of the clear ink is adjusted based upon not only the amount but also the kind of the color ink applied in the unit area, the clear ink application amount to each unit area can be more appropriate to largely reduce the gloss variations.

10 Claims, 9 Drawing Sheets

INKJET PRINTING METHOD AND INKJET PRINTING APPARATUS

BACKGROUND OF THE INVENTION

1. Field of the Invention

The present invention relates to an inkjet printing apparatus and an inkjet printing method, and particularly to an inkjet printing apparatus and an inkjet printing method which are suitable for producing a print object excellent in glossiness.

2. Description of the Related Art

The inkjet printing method flies small droplets of ink and attaches the small droplets on a print medium such as paper to perform a print and has been widely used even in the field of a high-fineness print owing to a recent technical advance. In recent years, pigment ink excellent in a light resistance, a gas resistance, a water resistance and the like has been increasingly used. In a case where a print is performed with pigment ink on a print medium having a smooth surface, such as an inkjet glossy paper developed for obtaining high-fineness image quality similar to that of a silver halide photography, there occurs a problem that coloring or glossiness of a print portion in the print medium is damaged by diffused reflection of light due to pigment particles in the pigment ink.

For solving this problem, methods of coating a print object with a transparent resin have been developed. For example, in an inkjet printing method described in Japanese Patent Application Laid-Open No. 2006-272934, an application amount of clear ink is determined in accordance with an application amount of pigment ink. In this printing method, the clear ink application amount is reduced on a portion of the print object in which the pigment ink application amount is large and the clear ink application amount is increased on a portion of the print object in which the pigment ink application amount is small, thus making a sum ink application amount per unit area on the entire print object uniform. This method has an object of realizing homogenization in glossiness on the print object.

According to the study of the inventors, however, it is considered that permeability of the clear ink and a remaining state of the clear ink on a surface layer of the resin component differ depending on the kind of the pigment ink and simply making the sum ink application amount per unit area uniform is not sufficient to prevent occurrence of gloss variations. In addition, on the portion to which the pigment ink is applied by a predetermined amount (target amount of the sum ink application amount), the clear ink is not applied, and the glossiness of the pigment ink itself can not be increased. When the clear ink is excessively applied to a pigment ink applying portion, the clear ink remains more than necessary, thereby degrading glossiness. Therefore, it is considered that the clear ink is not applied on the portion to which the pigment ink is applied by a predetermined amount.

The present invention is made in view of the foregoing problem and an object of the present invention is to provide an inkjet printing apparatus and an inkjet printing method which can produce a print object which is excellent in glossiness in its entirety and has largely reduced gloss variations.

SUMMARY OF THE INVENTION

According to an aspect of the present invention, there is provided an inkjet printing method of applying plural different kinds of color ink containing pigment as a coloring agent and clear ink not containing the coloring agent on a print medium to form an image thereon, wherein an amount of the clear ink applied in a unit area of the print medium is adjusted based upon an amount of each of the plural kinds of the color ink applied in the unit area.

According to another aspect of the present invention, there is provided an inkjet printing apparatus of applying plural different kinds of color ink containing pigment as a coloring agent and clear ink not containing the coloring agent on a print medium to form an image thereon, wherein an amount of the clear ink applied in a unit area of the print medium is adjusted based upon an amount of each of the plural kinds of the color ink applied in the unit area.

According to the present invention, there is provided an excellent effect of being capable of producing a print object which is excellent in glossiness in its entirety and has largely reduced gloss variations.

Further features of the present invention will become apparent from the following description of exemplary embodiments (with reference to the attached drawings).

DESCRIPTION OF THE EMBODIMENTS

Hereinafter, embodiments of the present invention will be in detail explained with reference to the accompanying drawings.

Figure 1:
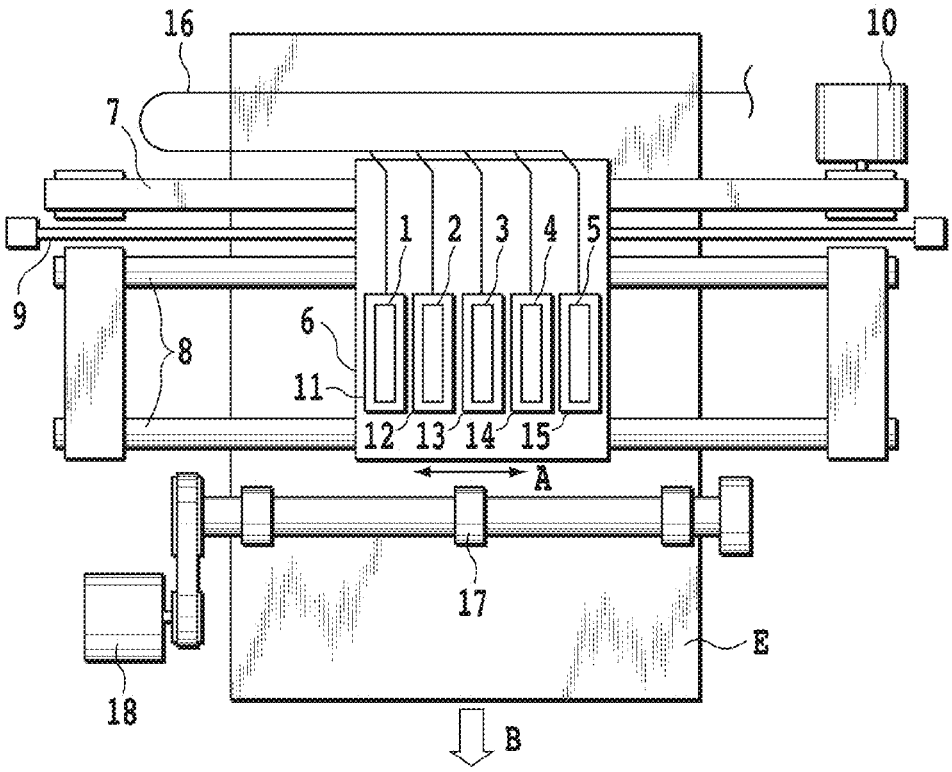
FIG. 1 is a schematic plan diagram showing an inkjet printing apparatus according to an embodiment of the present invention.

FIG. 1 shows a serial type inkjet printing apparatus used in the present embodiment. Numerals 1 to 5 in the figure denote print heads and in each of these print heads, plural ejection openings (nozzles) for ejecting ink and plural electro-thermal converters for generating thermal energy for ejecting the ink are arranged. Numerals 11 to 15 denote ink tanks, and the ink tanks 11 to 15 respectively accommodate ink of black (Bk), yellow (Y), magenta (M), cyan (Cy) and clear (Cl). These ink tanks 11 to 15 respectively supply the ink to the print heads 1 to 5. The print heads 1 to 5 and the ink tanks 11 to 15 are united to a cartridge, and a carriage 6 is moved and scanned in a scan direction A (right and left directions in the figure) with the cartridge mounted on.

The movement and scan of the carriage 6 is carried out through a drive belt 7 by a drive of a carriage motor 10 while being guided and supported by a guide shaft 8 and a linear encoder 9. A this time, followed by the movement of the carriage 6, timing for driving the print element of each of the print heads 1 to 5 is read from the linear encoder 9, and a drive signal corresponding to this timing is transferred to the electro-thermal converter in each of the print heads 1 to 5.

The electro-thermal converter of each of the print heads 1 to 5 is rapidly heated in response to this drive signal and bubbles occur in the ink abutting to the electro-thermal converter. An amount of ink droplets corresponding to the expansion of the bubble volume flies from the ejection openings, thereby performing ejection of the ink.

A control signal to each of the print heads 1 to 5 including this drive signal is transmitted through a flexible cable 16.

On the other hand, a print medium E for printing is carried in a sub scan direction B (arrow direction in the figure) followed by a drive of a carriage motor 18 while passing through carriage rollers (not shown) and then being held between discharge rollers 17. It should be noted that the sub scan direction B is also called a carriage direction and orthogonal to the scan direction A. The print medium E may be formed of various kinds of materials, such as paper, plain paper, exclusive paper suitable for obtaining a print image having high quality, OHP sheet, glossy paper, glossy film or post card.

Figure 2:
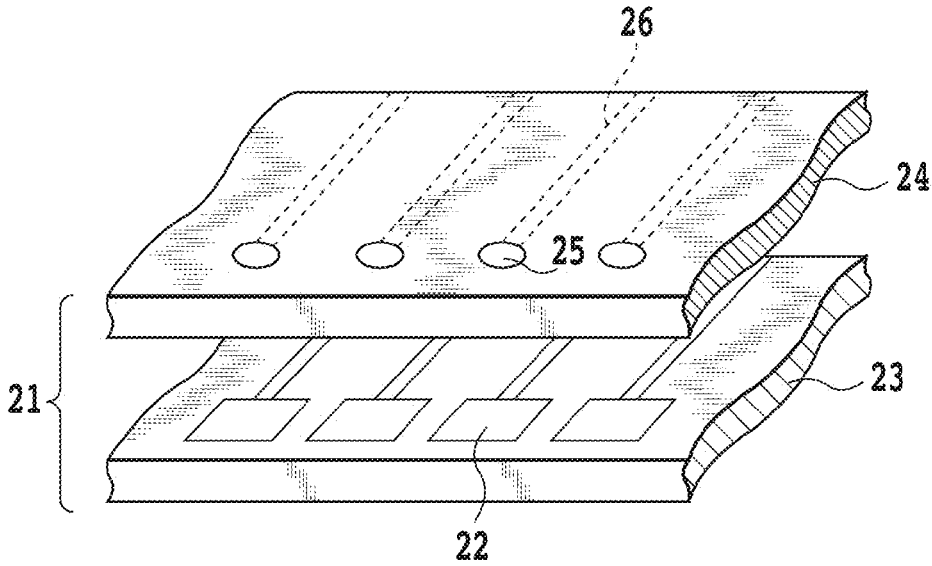
FIG. 2 is a schematic perspective diagram showing a structure of a print element in a print head of the inkjet printing apparatus.

FIG. 2 shows a structure of the print element in each of the print heads 1 to 5. The print element 21 is schematically configured by a heater board 23 provided with plural electro-thermal converters 22 formed thereon and a top plate 24 laminated on the heater board 23 to form flow passages of ink. Plural ejection openings (nozzles) 25 corresponding to the respective plural electro-thermal converters 22 are formed in the top plate 24. Tunnel-shaped liquid passages 26 communicating with the respective ejection openings 25 are formed in the backward of the respective ejection openings 25. The respective liquid passages 26 are communicated commonly with one ink liquid chamber (not shown) in the backward thereof and further, ink is supplied through an ink supply opening and an ink tube (both are not shown) to the ink liquid chamber from any of the ink tanks 11 to 15.

Figure 3:
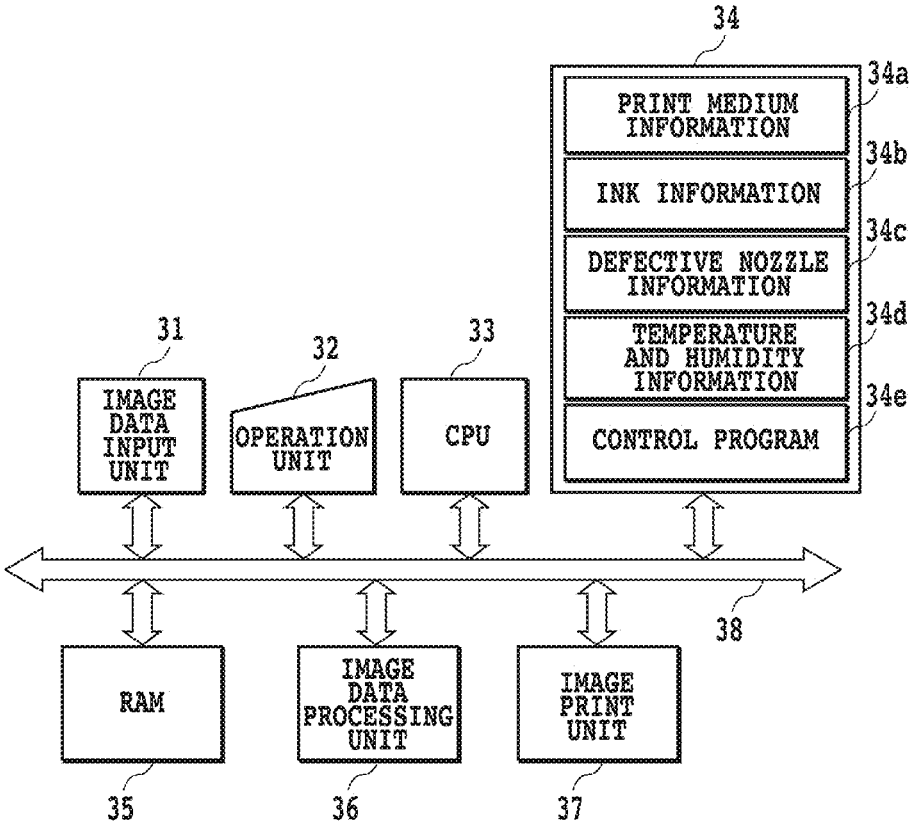
FIG. 3 is a block diagram showing an arrangement of a control system in the inkjet printing apparatus.

FIG. 3 shows an arrangement of a control system of the inkjet printing apparatus. Numeral 31 denotes an image data input unit and is means for inputting image data inputted from a scanner, a digital camera or the like and image data stored in a hard disc of a personal computer or the like. Numeral 32 denotes an operation unit and is provided with various keys for an operator to set various parameters and instruct a start of a print or the like. Numeral 33 denotes a CPU as a central processing unit and controls the entire printing apparatus according to programs in the storage medium 34.

A ROM, a FD, a CD-ROM, a HD, a memory card, an optical magnetic disc and the like can be applied to the storage medium 34. Examples of memory contents stored in the storage medium 34 include information 34*a* in regard to the kinds of the storage medium and information 34*b* in regard to ink. In addition, information 34*c* in regard to presence/absence and positions of defective nozzles, information 34*d* in regard to an environment such as temperature or humidity when printing, various control programs 34*e* and the like are also included.

Numeral 35 denotes a RAM and is used as a work area for executing the various programs stored in the storage medium 34 and as a temporal retreat area of necessary data at error processing. Further, various data stored in the storage medium 34 can be temporarily copied in the RAM 35. The CPU 33 can change the copied data content in the storage medium 34 or can further proceed with the image processing by referring to the changed data.

Numeral 36 denotes an image data processing unit. The image data processing unit 36 executes quantization processing of converting multi-valued image data inputted from the image data input unit 31 into ejection data which has a lower level value to be printable by the print head. For example, in a case where the data inputted from the image data input unit 31 is the multi-valued image data expressed in eight bits (256 gradations)×three colors (RGB), the multi-valued image data is first divided into four elements (CyMYBk) of gray scale data in the image data processing unit 36. Next, based upon the divided gray scale data of each color, the data is converted into a dot arrangement data printable by the print head. Here, in a case where the print head can perform a print based only upon two pieces of information as ejection and non-ejection, the data is converted into a binary value according to a pattern defined in either one of print and non-print. In a case where the print head can control an ejection amount in plural steps respectively, the data value is reduced to the printable step number. At this time, examples of subtractive color processes to be applied may include a generally known multi-valued error dispersion process. In addition, besides, any gradation processing method such as an average density preservation process or a dither matrix process may be applied.

Further, in a case of performing a multi-path print or in a case where the print head is provided with plural nozzle lines of the same color, a further image division is made in the image data processing unit 36. That is, the ejection is dispersed to plural print scans in a case of the multi-path print, and in a case of the plural nozzle lines, the ejection is dispersed to the respective nozzle lines. Examples of the method include a method of dividing the image data into more data (thin in density) in producing the gray scale data or a method of integrating masks defined in respective paths or respective nozzle lines to the dot arrangement data.

Numeral 37 denotes an image print unit for performing image output and generates a pulse for driving the print head according to the ejection pattern produced in the image data processing unit 36 to eject ink from the ejection openings in the print head.

Numeral 38 denotes a bus for transferring various data and transmits address signals, data and control signals in the printing apparatus.

Next, the inkjet printing method of the present embodiment using the above-mentioned inkjet printing apparatus will be explained.

In the inkjet printing method of the present embodiment, color ink containing pigment as a coloring agent and clear ink not containing the coloring agent are used and these pieces of the ink are applied or ejected on a print medium such as paper to form an image thereon. Here, the color ink includes ink of plural kinds or different colors of black (Bk), yellow (Y), magenta (M) and cyan (Cy) accommodated respectively in the ink tanks 11 to 14, and the clear ink includes ink of clear (Cl) accommodated in the ink tank 15. Particularly in the present embodiment, it is preferable to use the clear ink in which a vinyl resin (styrene acrylic resin and acid value of 140) is dissolved in water, in which an organic solvent and a surface active agent are contained.

The clear ink is applied on a color ink print surface and a print medium to be formed in a film shape thereon for making the print surface smooth, thereby improving glossiness. On the other hand, according to the study of the inventors, it is found out that a clear ink application amount required for obtaining a predetermined glossiness differs depending on the kind of color ink in a clear ink applied portion and the kind of the print medium.

Figure 4:
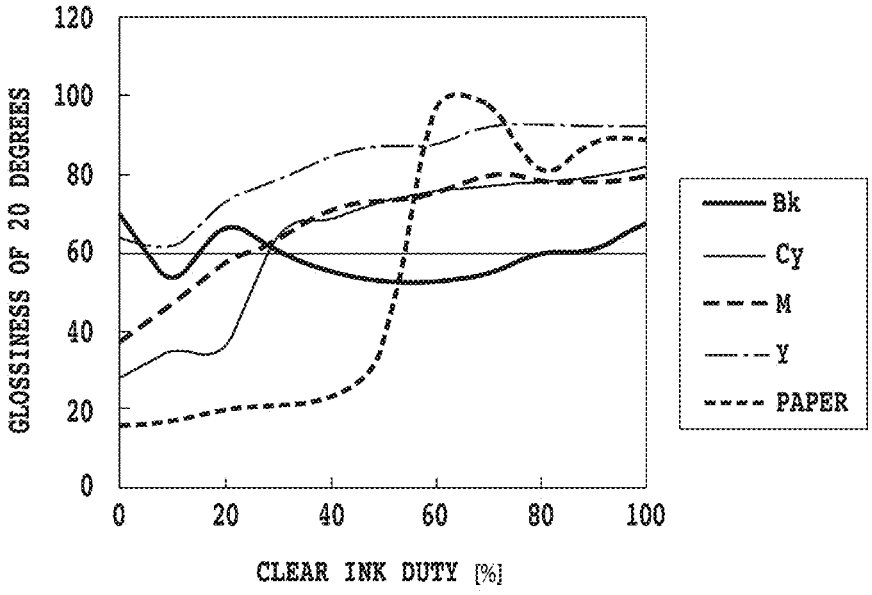
FIG. 4 is a graph showing a relation between a clear ink application amount and glossiness of 20 degrees corresponding to each color of color ink and a print medium.

FIG. 4 is an example of the test result. Here, clear ink is applied to a print object having a duty of 75% of color ink in each color By, Cy, M and Y and a non-print object having no application of color ink, that is, a print medium (paper) itself. In addition, further an application amount of the clear ink, that is, the duty of the clear ink is changed to check glossiness of 20 degrees to each clear ink application amount. From FIG. 4, it is found out that the clear ink application amount required for making the glossiness of 20 degrees a predetermined target value (here, 60) differs depending on the kind or the color of the color ink. In addition, the required clear ink application amount differs also depending on the kind of the print medium.

Figure 5:
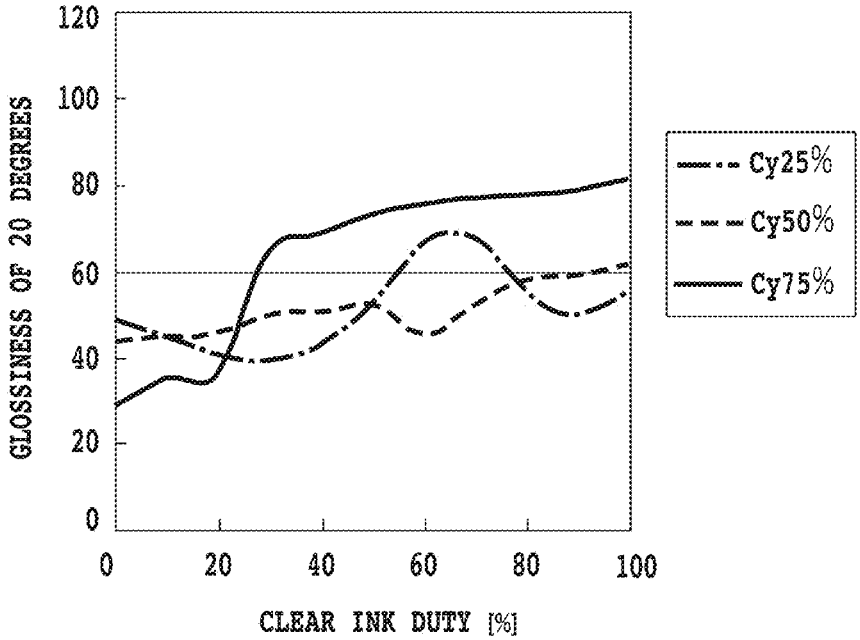
FIG. 5 is a graph showing a relation between a clear ink application amount and glossiness of 20 degrees corresponding to each amount of color ink.

Further, depending not only on the kind of the color ink but also on the application amount of the color ink, the clear ink application amount required for obtaining glossiness equal to a target value differs. FIG. 5 is an example of the test result. FIG. 5 shows glossiness of 20 degrees at the time of applying clear ink to each of print objects printed by cyan (Cy) ink of a duty of 25%, 50% or 75%. From FIG. 5, it is found out that the clear ink application amount required for glossiness of 20 degrees to reach a target value differs depending on the color ink application amount.

As described above, for improving glossiness of the print object and reducing gloss variations, it is preferable to adjust the application amount of clear ink based not only upon the amount of color ink applied in a fine unit area of the print medium but also upon the kind of the color ink. Therefore, the present embodiment is configured to carry out this event. Hereinafter, a specific printing method will be explained.

Figure 6:
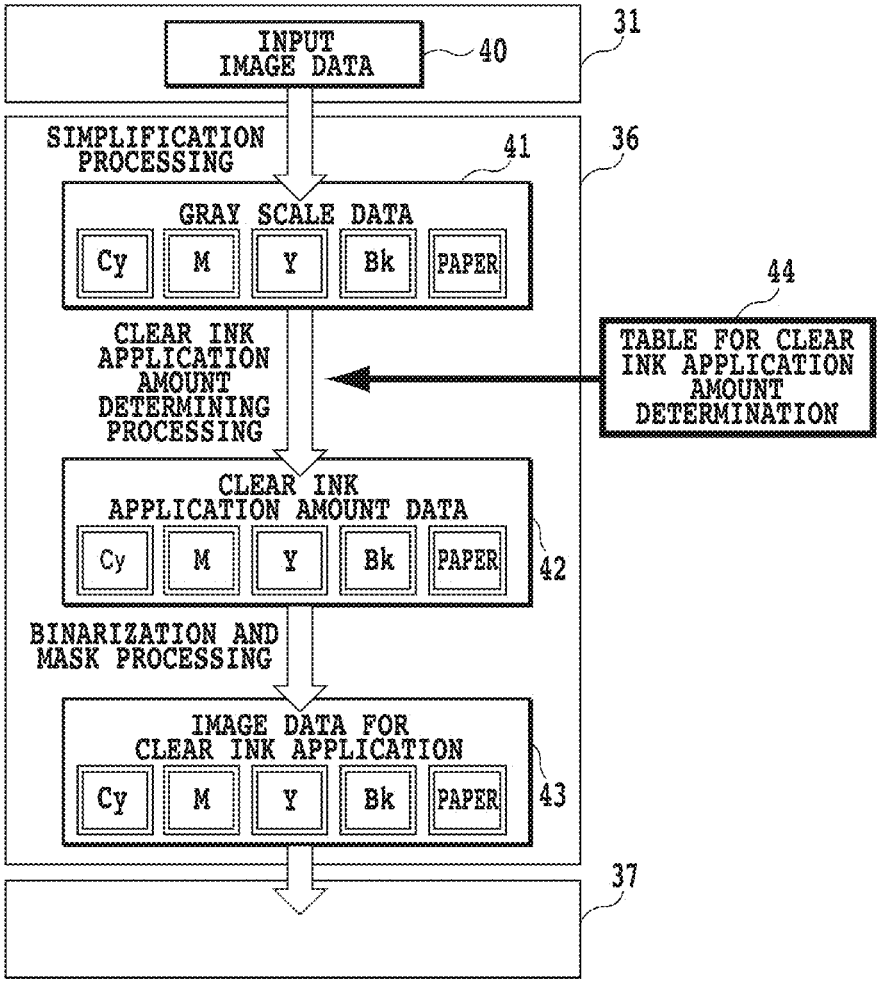
FIG. 6 is a block diagram showing an inkjet printing method according to the embodiment of the present invention.

First, with reference to FIG. 6, the procedure from input of image data to an ink application, which will be executed in the control system, will be explained.

First, to input image data 40 inputted to the image data input unit 31, monochrome processing is executed for each color of color ink in the image data processing unit 36 to produce gray scale data 41 having position information and density information of each color and each print medium.

Figure 8:
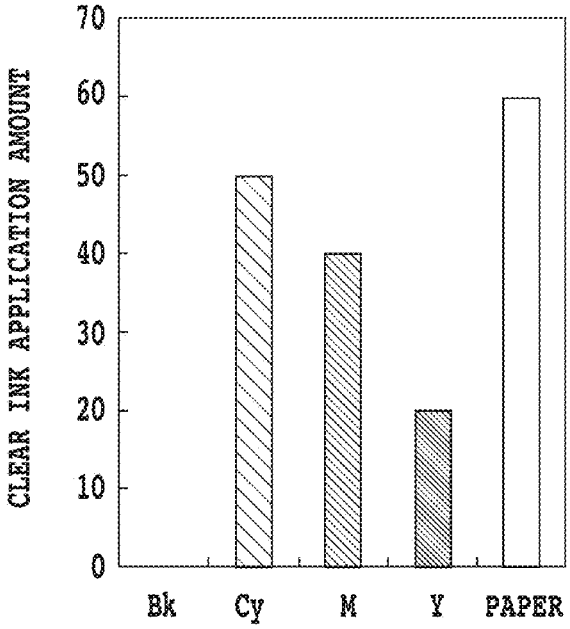
FIG. 8 is a diagram showing a table for clear ink application amount determination according to the embodiment of the present invention.
Figure 9:
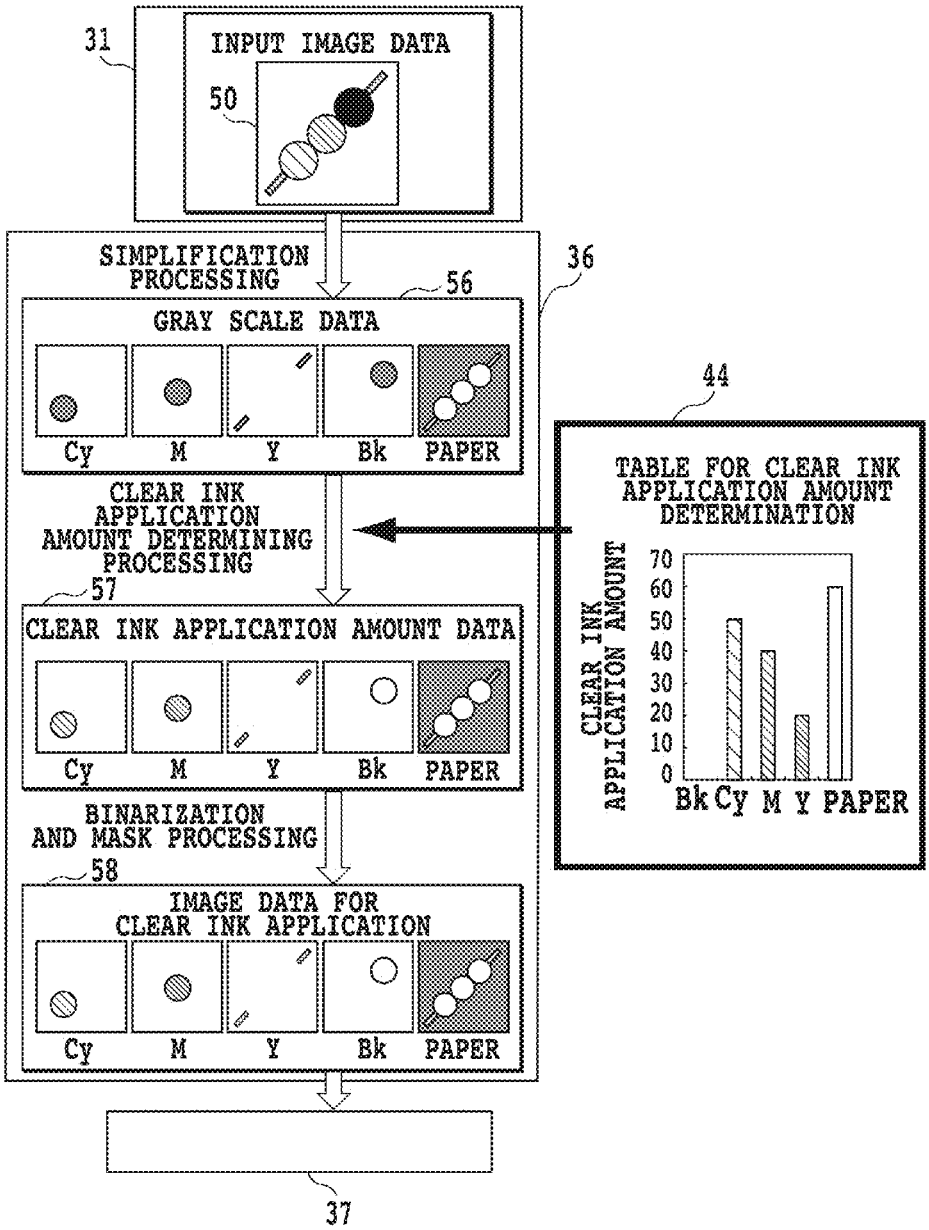
FIG. 9 is a block diagram showing the inkjet printing method according to the embodiment of the present invention.

An application amount of clear ink to each unit area is determined based upon a duty of color ink for each unit area of the gray scale data 41 thus obtained. In this determination process, a table 44 for a clear ink application amount determination is referred to. It should be noted that the specific table 44 for the clear ink application amount determination is as shown in FIGS. 8 and 9.

The table 44 defines a relation between an amount and a kind (specially color) of color ink to be applied in a unit area, and an amount of clear ink to be applied in the same unit area. It should be noted that, this table includes a case where the amount of color ink is zero, and in this case, the amount of clear ink to be applied in the unit area of the print medium E is defined. Such a relation or clear ink amount may be defined for each kind of the print medium E.

The table 44 defines the amount of clear ink in such a manner that glossiness of 20 degrees in a unit area reaches a predetermined target level. In the present embodiment, the target level in glossiness of 20 degrees is in a range of 60 to a predetermined value exceeding 60 and being substantially equal thereto.

The table 44 is in advance produced based upon, for example, the test results in FIGS. 4 and 5 and the like and is stored in the storage medium 34. The application amount of clear ink is determined in each unit area according to the content of the table 44. By determining the clear ink application amount using such a table 44, it is possible to easily and appropriately determine the clear ink application amount in accordance with the amount and the kind of color ink.

Next, the determined clear ink application amount is converted into a duty corresponding thereto to produce clear ink application amount data 42. It should be noted that the clear ink application amount may be determined directly as having a unit of duty in the above-mentioned determined process. Further, by binarizing the clear ink application amount data 42 and performing mask processing to it, binary image data 43 for clear ink application are obtained.

The binary image data 43 for the clear ink application thus produced is transmitted to an image print unit 37 after predetermined information is added as required. In addition, color ink is ejected from the color ink print heads 1 to 4 for each unit area. Immediately after printing the color ink, clear ink is ejected from the clear ink print head 5 for the attaching. This operation is repeatedly performed for each unit area and is also performed to the entire print area of the print medium E. Here, "print area" means an area where at least one of the color ink and the clear ink is applied and a portion found by subtracting a blank portion from the print medium E.

In consequence, the amount of the clear ink applied to the unit area is adjusted based upon the amount and the kind of the color ink applied in the unit area. It should be noted that in a case of defining the relation between the amount and the kind of the color ink for each kind of the print medium E, the clear ink amount results in being adjusted based also upon the kind of the print medium E.

In the print area, both of the application area and the non-application area of the color ink result in having uniform glossiness equal to the target level. In addition, all of the individual unit areas in the print area result in having uniform glossiness equal to the target level. Therefore, it is possible to greatly reduce the gloss variations over the entire print area. That is, since the clear ink is applied in such manner as to produce constant glossiness in the individual unit area, the variations in gloss in the entire print area can be largely reduced. Further, the excessive application of the clear ink and glossiness degradation due thereto can be securely prevented.

In consequence, it is possible to produce a print object which is excellent in glossiness in its entirety and has a large reduction in gloss variations.

It should be noted that in a supplementary way, "duty" means a value calculated in an expression of "duty (%)=actual print dot number/(vertical pixel number×lateral pixel number)×100". In the expression, "actual print dot number" means an actual print dot number per unit area. In addition, "vertical pixel number" and "lateral pixel number" respectively mean a vertical pixel number and a lateral pixel number per unit area.

For example, in a case of performing a multi-path print of eight paths, the vertical pixel number in the unit area can be made equivalent to ⅛ of a nozzle arrangement length of the print head. The lateral pixel number in the unit area can be made the same pixel number as the vertical pixel number. Here, resolution of the vertical pixel line is 1200 dpi and resolution of the lateral pixel line is 2400 dpi.

Incidentally, when the clear ink is applied in the above method, a portion (for example, to which the print medium is exposed) where the clear ink tends to easily permeate is difficult to be permeated into by clearcole. Therefore, it is considered that the degree of easiness in permeation of the clear ink in the entire print area becomes uniform. In addition, it is found out that even if the clear ink has a high permeation, when such clear ink is applied by plural times respectively, the clear ink tends to easily remain on the print medium.

Accordingly, it is preferable that after at least one of the color ink and the clear ink is applied in the unit area, a constant amount of the clear ink is further applied (overcoated) on the same unit area. In this case, the plural ejection openings 25 of the clear ink print head 5 may be divided into two groups, where a first clear ink application is performed by the first group and a second clear ink application is by the second group. By this way, the overcoat can be simultaneously performed by one scan. Or after completing the first clear ink application on the entire print medium, the print medium may be returned back to the first print start position to perform the second clear ink application therein.

By performing such an overcoat, a print surface of the print medium can be coated in a more smooth state to obtain a print object having better glossiness. Since the clear ink amount for each unit area used for the overcoat is constant, it is possible to restrict occurrence of gloss variations due to the overcoat performance.

Embodiment

Hereinafter, embodiments of the present invention will be shown.

<Color Ink> It is the following ink containing pigment as a coloring agent.

Black: PFI-103Bk (made by Canon)
Magenta: PFI-101M (made by Canon)
Yellow: PFI-101Y (made by Canon)
Cyan: PFI-101C (made by Canon)<

<Clear Ink>

| | |
|---|---|
| Styrene acrylic resin (acid value 140) | 4 parts |
| 1,2-hexanediol | 7.5 parts |
| surface active agent (BYK333) | 1 part |
| pure water | the rest |

The gloss meter of 20 degrees (GMX-203 made by MCRL CO) was used for evaluation of glossiness. Inkjet print paper of a glossy type (UF170 made by Mitsubishi Paper Mills CO) was used.

Figure 7:
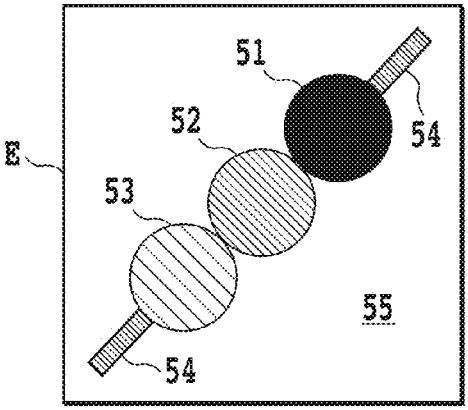
FIG. 7 is a diagram showing an image according to the embodiment of the present invention.

FIG. 7 shows an image used in the present embodiment. This image is composed of a black color area 51, a magenta color area 52, a cyan color area 53, a yellow color area 54 and a white color area 55 as a base color of the print medium E. The density of each color area other than the white color area 55 is 75% duty having resolution of 1200 dpi×2400 dpi.

As described above, at the time of determining the clear ink application amount, it is necessary to refer to the table 44 for the clear ink application amount determination. Hereinafter, a method of producing this table will be shown.

The color ink of four colors of the above black, magenta, yellow and cyan, and the above clear ink are mounted on the inkjet printing printer (JF900 made by Canon). The color ink of each color is used to a printed surface of an inkjet print sheet to print an image of 75% duty having resolution of 1200 dpi×2400 dpi in a multi-path by eight times (eight paths) respectively. Immediately after it, the clear ink is applied by one time with the duty of 0 to 100%.

The specular glossiness in an incidence angle of 20 degrees in regard to each print portion of the print object thus produced is measured using the glossiness meter. This result is as shown in FIG. 4.

Based upon the above result, the clear ink application amount per unit area, that is, the clear ink duty is determined in such a manner that the specular glossiness of 20 degrees on the print object with 75% duty of each color ink and on the print medium becomes a target level. The determined clear ink application amount is as shown in FIG. 8. It should be noted that a unit in the vertical axis of the graph in the figure is duty percent. The table shown in FIG. 8 is used as the table 44 for the clear ink application amount determination.

Next, the inkjet printing method according to the present embodiment will be explained with reference to FIG. 9.

First, in the image data processing unit 36, monochrome processing is executed for each of four colors of the color ink to the input image data 50 inputted to the image data input unit 31 to produce gray scale data 56 having position information and density information in regard to the color and the print medium.

Each information of the gray scale data 56 thus obtained and the table 44 for the clear ink application amount determination in advance obtained are used to produce clear ink application amount data 57 for each unit area. Since each color of a color print unit printed in the present embodiment has 75% duty, the table 44 for the clear ink application amount determination shown in FIG. 8 is used.

Next, the clear ink application amount data 57 is binarized and mask-processed to obtain binary image data 58 for clear ink application.

The binary image data 58 for the clear ink application thus produced is transmitted to the image print unit 37 of the inkjet printer. After the color ink of four colors is printed by eight times respectively, the clear ink is applied according to the binary image data 58 for the clear ink application.

For example, in an area where cyan Cy is printed, the clear ink of 50% duty is applied according to the table 44. Likewise, the clear ink of 40% duty is applied in an area where magenta M is printed, and the clear ink of 20% duty is applied in an area where yellow Y is printed. Since in an area where black Bk is printed, the clear ink of 0% duty is shown according to the table 44, the clear ink is not applied (that is, the clear ink of 0% duty is printed). In an area where any color is not printed, the clear ink of 60% duty to the paper is applied. In this way, since the clear ink application amount is adjusted in such a manner that the glossiness becomes a constant target level in any location of the print area and as a result, the glossiness in the entire print area is uniform, the gloss variations are largely reduced.

It should be noted that the dot pattern of the clear ink in a unit area can be arbitrarily set to the dot pattern of the color ink in the unit area. For example, regardless of the dot pattern of the color ink, the dot pattern of the clear ink can be set at a random.

The present embodiment has explained a case where the color ink of one color per unit area is applied by a constant amount (75% duty). However, even in a case where the color ink of plural colors per unit area is applied or a color ink sum amount per unit area differs, the present invention can be applied. In this case, the clear ink application amount may be in advance determined in the form of a table or the like such that the glossiness becomes the target level for each combination of colors of the color ink, each color ink application amount or each color ink application ratio, and the clear ink application amount may be determined and adjusted according to this relation.

In the above, the embodiment of the present invention is mentioned, but the present invention can be applied in different embodiments. For example, in regard to the kind of the color ink, the color is exemplified in the present embodiment, but for example, it may be exemplified as a content component or the like. In regard to the glossiness, the glossiness of 20 degrees is used in the above embodiment, but the glossiness of a different angle, that is, the glossiness of 60 degrees may be used. Likewise, the target level of the glossiness can be changed to a different numerical level.

The embodiment of the present invention is not limited to the above-mentioned embodiments, but all modifications, applications and equivalents contained in the spirit of the present invention defined in the scope of claims can be included in the present invention. Therefore, the present invention should not be interpreted in a limited way and can be applied to other arbitrary technologies encompassed within the spirit of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-183539, filed Aug. 6, 2009, which is hereby incorporated by reference herein in its entirety.

What is claimed is:

1. An inkjet printing method of applying color ink containing coloring agent and clear ink not containing the coloring agent in substance on a unit area of a print medium by a printing unit to form an image thereon, the method comprising the steps of:

obtaining an amount of the color ink applied in the unit area;

determining an amount of the clear ink to be applied to the unit area based upon the amount of the color ink applied in the unit area obtained in the obtaining step, such that glossiness of the image formed on the unit area becomes equal to or more than a predetermined target value, based on a relation between the amount of the color ink and the amount of the clear ink required for making the glossiness of the image formed on the unit area applied with the amount of the color ink become equal to or more than the predetermined target value; and causing the printing unit to apply the clear ink on the print medium in accordance with the determined amount of clear ink, wherein the amount of the clear ink determined in a case where the amount of the color ink is a first amount is greater than i) the amount of the clear ink determined in a case where the amount of the color ink is a second amount which is less than the first amount and ii) the amount of the clear ink determined in a case where the amount of the color ink is a third amount which is greater than the first amount.

2. An inkjet printing method according to claim 1, wherein the glossiness is 20 degrees.

3. An inkjet printing method according to claim 2, wherein the predetermined target value is 60.

4. An inkjet printing method according to claim 1, wherein plural different kinds of color ink are applied by the printing unit, the amount of the clear ink to be applied in the unit area is determined in the determining based upon a relation determined in advance between the amount of each of the plural kinds of the color ink applied in the unit area and the amount of the clear ink applied in the unit area.

5. An inkjet printing method according to claim 1, further comprising the step of further applying the clear ink to the unit area after applying the color ink and the clear ink to the unit area.

6. An inkjet printing apparatus comprising:

an ink applying unit configured to apply color ink containing a coloring agent and clear ink not containing the coloring agent in substance on a print medium to form an image thereon;

an obtaining unit configured to obtain an amount of the color ink applied in the unit area;

a determining unit configured to determine an amount of the clear ink to be applied to the unit area based upon the amount of the color ink applied in the unit area obtained by the obtaining unit, such that glossiness of the image formed on the unit area becomes equal to or more than a predetermined target value, based on a relation between the amount of the color ink and the amount of the clear ink required for making the glossiness of the image formed on the unit area applied with the amount of the color ink become equal to or more than the predetermined target value; and a controlling unit configured to cause the ink applying unit to apply the clear ink on the print medium in accordance with the amount of clear ink determined by the determining unit, wherein the amount of the clear ink determined in a case where the amount of the color ink is a first amount is greater than i) the amount of the clear ink determined in a case where the amount of the color ink is a second amount which is less than the first amount and ii) the amount of the clear ink determined in a case where the amount of the color ink is a third amount which is greater than the first amount.

7. An inkjet printing apparatus according to claim 6, wherein the glossiness is 20 degrees.

8. An inkjet printing apparatus according to claim 7, wherein the predetermined target value is 60.

9. An inkjet printing apparatus according to claim 6, wherein plural different kinds of color ink are applied by the ink applying unit, the amount of the clear ink to be applied in the unit area is determined by the determining unit based upon a relation determined in advance between the amount of each of the plural kinds of the color ink applied in the unit area and the amount of the clear ink applied in the unit area.

10. An inkjet printing apparatus according to claim 6, wherein the ink applying unit applies the clear ink to the unit area after applying the color ink and the clear ink to the unit area.

* * * * *